US009763501B2

(12) United States Patent
Supino

(10) Patent No.: US 9,763,501 B2
(45) **Date of Patent: *Sep. 19, 2017**

(54) BEACH UMBRELLA ANCHORING SYSTEM

(71) Applicant: John Supino, New Milford, NJ (US)

(72) Inventor: John Supino, New Milford, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/040,701

(22) Filed: Sep. 29, 2013

(65) Prior Publication Data

US 2015/0090307 A1 Apr. 2, 2015

(51) Int. Cl.
*A45B 3/00* (2006.01)
*E04H 12/22* (2006.01)

(52) U.S. Cl.
CPC ..... *A45B 3/00* (2013.01); *E04H 12/2246* (2013.01); *A45B 2200/1054* (2013.01)

(58) Field of Classification Search
CPC ..... A45B 25/02; A45B 25/22; A45B 3/00; A45B 3/10; A45B 2025/003; A45B 2023/0012; A45B 2200/1054; E04H 12/2246; A47G 25/12
USPC ..... 135/16, 98–99, 33.2, 33.4, 33.41, 334.2, 135/118, 120.1; D3/5, 10–11; 248/507–508, 518, 519, 529, 530–533, 248/910; 383/72, 75, 12, 19, 22; 211/197
See application file for complete search history.

(56) References Cited

U.S. PATENT DOCUMENTS 1,204,804 A * 11/1916 McGowan ..... A45B 25/18 135/33.2
2,681,070 A * 6/1954 D'Ippolito ..... A45B 25/18 135/16
D284,618 S * 7/1986 St. John ..... D3/5
4,832,163 A * 5/1989 Levesque ..... 190/11
5,169,111 A * 12/1992 Dunaj ..... 248/523
5,441,064 A * 8/1995 Becker et al. ..... 135/16
5,452,877 A * 9/1995 Riffle et al. ..... 248/511
6,068,325 A * 5/2000 Hughes ..... B60J 7/08 280/DIG. 5
6,199,570 B1 * 3/2001 Patarra ..... 135/16
6,543,465 B2 * 4/2003 Choi ..... E04H 15/32 135/120.1

(Continued)

FOREIGN PATENT DOCUMENTS

JP 09125748 A * 5/1997 ..... E04H 15/62
JP 2005318919 A * 11/2005

*Primary Examiner* — Winnie Yip
(74) *Attorney, Agent, or Firm* — Ostrager Chong Flaherty & Broitman P.C.

(57) ABSTRACT

A beach umbrella anchoring system comprising a restraining device or container for preventing the beach umbrella from being blown about by unexpected, sudden gusts of wind comprising a container, i.e., a beach bag for containing ballast or a weighting medium such as sand, dirt, small rocks and the like therein to anchor the umbrella, a beach umbrella having easily accessible storage areas in the form of at least one pocket attached to at least one seam found on the interior of the umbrella. The beach umbrella is provided with a support shaft having a tapered end so as to facilitate insertion of the shaft into beach bag and/or the sand on the beach to provide the sole support for the umbrella. If a container or beach bag containing sand or dirt is provided, the support shaft will pass through the same and into the sand on the beach.

9 Claims, 8 Drawing Sheets

(56) References Cited

U.S. PATENT DOCUMENTS

| | | | | |
|---|---|---|---|---|
| 7,581,555 | B2 * | 9/2009 | McCullough | 135/33.2 |
| 7,918,236 | B2 * | 4/2011 | Elder | A45B 11/00 135/16 |
| 7,946,305 | B1 * | 5/2011 | Mailman | 135/16 |
| 8,424,549 | B1 * | 4/2013 | Goldsmith et al. | 135/120.4 |
| 2004/0118058 | A1 * | 6/2004 | Bigford | 52/169.13 |
| 2012/0011773 | A1 * | 1/2012 | Cross et al. | 47/65.8 |
| 2013/0051707 | A1 * | 2/2013 | Pisano et al. | 383/75 |

* cited by examiner

BEACH UMBRELLA ANCHORING SYSTEM

This application claims priority from Provisional Application Ser. 61/671,415 filed Jul. 13, 2012.

BACKGROUND OF THE INVENTION

The present invention is directed to a portable beach umbrella anchoring system, and more particularly to a beach umbrella having easily accessible storage areas in the form of at least one pocket attached to at least one seam found on the interior of the umbrella.

Still more particularly, the present invention is directed to a beach umbrella anchoring system comprising a restraining device or container for preventing the beach umbrella from being blown about by unexpected, sudden gusts of wind comprising a container in the form of a beach bag for containing ballast or a weighting medium such as sand, dirt, small rocks and the like therein to anchor the umbrella, and the beach umbrella having easily accessible storage areas in the form of at least one pocket attached to at least one seam found on the interior of the umbrella. The beach umbrella is provided with a support shaft having a tapered end so as to facilitate insertion of the shaft into the sand of the beach to provide the sole support for the umbrella.

The umbrella anchoring system includes a vertical central support shaft or pole and a closeable umbrella mounted adjacent the upper end of the support shaft.

The lower end of the support shaft, which is of suitable shape to be inserted into an opening provided at the top of the beach bag, to pierce or pass through the sand or other weighting material in the beach bag, and to pierce the underlying ground or sand after passing through an opening provided in the bottom of the beach bag. In this manner, the umbrella is easily secured in the sand or ground for providing the stability required in use and for preventing the beach umbrella from blowing about if up-ended by a sudden and unexpected gust of wind.

The umbrella is further provided with at least one storage area in the form of a utility pocket formed of a flexible material attached to the interior undersurface of the umbrella. The pockets may be made of a fabric such as canvas, plastic, nylon or any other flexible material and are intended for the purpose of holding personal articles such as wallets, car keys, other valuables including money, jewelry, glasses, sun screen or the like.

The anchoring member or umbrella restraining device, i.e., the beach bag is more fully described in applicant's co-pending application Ser. No. 13/239,661 filed Sep. 22, 2011, which is incorporated herein in its entirety by reference thereto.

In a further aspect of the invention, there is provided a beach umbrella anchoring system comprising a container or beach bag for receivably containing a weighting medium and a beach umbrella comprising a support shaft which may be formed of a single section or of an upper section and a lower section which may be interconnected through a joint so as to allow disassembly and ease of transportation. The upper section of the support shaft has a plurality of ribs pivotally connected thereto. A corresponding strut is pivotally connected to each rib and all of the struts of the upper section of the support shaft may be releaseably locked in an upper position whereby the ribs are extended in a radial manner from the support shaft. A fabric cover is supported by the ribs.

The pockets found on the interior of the umbrella which are preferably made of a suitable flexible, lightweight material such as canvas or plastic, and more particularly made of such a material containing a number of perforations forming a mesh- or net-like material. The openings permit the flow of air therethrough and can even find application for drying small articles of clothing which have been wet in use. The size and arrangement of the pockets places the stored items out of reach of the beach goer but still provides easy access when a stored item has to be retrieved.

The pockets or compartments are attached by sewing a pocket edge into a seam of the umbrella or by use of properly applied Velcro® or glue. Thus the beach umbrella anchoring system of the invention provides a beach umbrella with compartments or pockets for storing necessary personal and other items together with a restraining device and namely a beach bag for holding sand or other weighting material whereby the beach umbrella is prevented from blowing about as a result of sudden or unexpected gusts of wind.

The beach umbrella is openable and closeable by the conventional means affixed to the central support shaft or pole.

The central support shaft is made of a lightweight yet sturdy material such as aluminum, PVC or wood. The shaft has an upper end at which the umbrella is mounted and a base end of a suitable shape and strength to pierce the sand or other weighting material contained in the bag and to then pierce the sand or ground on which the bag has been placed. The beach umbrella-bag combination ensures that the beach umbrella, having a support shaft with a tapered end so as to facilitate insertion of the shaft of the beach umbrella into the sand or ground, is provided sufficient support and a relatively stable structure, whereby the beach umbrella is not liable to topple or to be upended by sudden and unexpected gusts of wind, and the tapered end of the support shaft can then become a dangerous hazard to users of the umbrella and other people on the beach.

The provision of the container in the form of a beach bag allows the umbrella and bag to be readily carried to the beach. The beach bag is adapted for containing a weighting material, such as sand or gravel for the purpose of stabilizing the entire structure, permitting it to resist wind and other distorting influences. The combination of the umbrella and container or bag thus provides a system effective to anchor the beach umbrella against being overturned and flailing about in sudden or unexpected gusts of wind. The combination of the umbrella and container or bag of the invention where the umbrella provides easily accessible storage areas in the form of pockets adapted to be filled with essentials for the person who requires the same for the long hours spent on the beach, such as small electronics, wallets, car keys, valuables such as money, a watch, glasses, sun screens and the like.

The storage areas, and preferably a plurality thereof, are made of canvas, plastic or other flexible, lightweight material and as provided are in the form of meshes, the openings being large enough to permit the flow of air therethrough but small enough so as to enable the retention of small items, such as car keys, lipstick, parking tickets and the like. The pockets are closed on three sides and the fourth or top side has one side of the pocket opening attached to a seam of the umbrella by sewing, glue or Velcro. The other or open and unattached side permits easy access to the pocket or compartment in order to place items in storage or to retrieve items earlier placed therein. The pockets or compartments may be provided with zipper, button, or Velcro® release tape closure means. The pockets, and preferably 2 to 6 of the same, are adhered (sewing, glue, Velcro® and the like) to an internal seam of the umbrella so that in use they are 4-7 feet off the ground and so within easy reach of a person lying or sitting underneath the umbrella.

The pockets need not be rectangular in shape but may be circular or oval in shape.

Their size is limited so that the weight of the articles stored does not cause the bags to sag or become disengaged from the umbrella. Varying sizes of the bags may be used, but they should be capable of being accommodated by varying sizes of umbrellas.

The beach umbrellas are provided with a support shaft having a tapered end so as to facilitate insertion of the shaft into the sand of the beach or sand or rocks provided in the beach bag or container to provide the sole support for the umbrella.

SUMMARY OF THE INVENTION

Accordingly, it is one object of the present invention to provide a beach umbrella restraining system whereby the beach umbrella may be prevented from blowing about if up-ended by a sudden and unexpected gust of wind.

It is a further object of the present invention to provide a beach umbrella anchoring system whereby the beach umbrella shaft may be conveniently secured in a bag or container containing sufficient weighting so as to anchor the umbrella and prevent the umbrella from being blown about as a result of sudden and unexpected gusts of wind.

It is a still further object of the present invention to provide a kit whereby the necessary apparatus and materials for anchoring the beach umbrella may be conveniently carried to and from the beach.

As will become more readily apparent hereinafter, these objects of the invention and others that will become apparent, may be attained by the provision of a beach umbrella restraining device comprising a portable beach umbrella comprising a vertical central support shaft; a closeable umbrella member mounted on the upper end of said support shaft; a container to be positioned at the lower end of said support shaft for stabilizing said beach umbrella, the lower end of said shaft being of a suitable shape to pierce the ground or the sand on which the container rests; at least one internally accessible compartment or bag generally in the form of a pocket secured to an interiorly accessible seam of said umbrella, the arrangement placing stored items in reach of the beach umbrella user making it easy for him to store and recover keys, glasses, suntan lotion or other storable items.

Accordingly, it is a primary object of the present invention to provide an efficient, compact and portable beach umbrella which includes essential conveniences for the serious beach goer, and further includes a beach umbrella anchoring or restraining device whereby the beach umbrella may be prevented from blowing about or being up-ended by sudden and unexpected gusts of wind.

The primary object of the present invention is fulfilled by providing a portable beach umbrella comprising a vertical central support shaft having a tapered lower end so as to facilitate insertion of the shaft into the sand or earth to provide support for the umbrella; a closeable umbrella member mounted at the upper end of said support shaft; an anchor member comprising a container means for receivably containing a predetermined mass of a weighting medium adapted to be positioned at the lower end of the support shaft to provide support for the beach umbrella; and at least one compartment or storage area generally in the form of pockets secured to at least one seam in the interior of the beach umbrella.

The provision of the container or bag adapted to contain a weighting material such as sand or gravel to anchor the beach umbrella, which is preferred but not necessarily required, serves also when empty for conveniently carrying necessary apparatus and materials to and from the beach.

The scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

It should be understood that the combination disclosed and claimed may be used in a recreational manner in any suitable setting and that its utility is not confined to the beach.

BRIEF DESCRIPTION OF THE DRAWINGS

The present invention will become more fully understood from the detailed description given hereinbelow and the accompanying drawings which are given by way of illustration only, thus, are not limitative of the present invention, and wherein:

Referring to FIG. 1, there is generally shown a portable beach umbrella 10. The beach umbrella 10 includes an umbrella or shade member 12 which may be canvas, plastic or any other suitable, flexible shading material and is openable and closable by a conventional closure member 13 fixed to a central support shaft 14.

Figure 1:
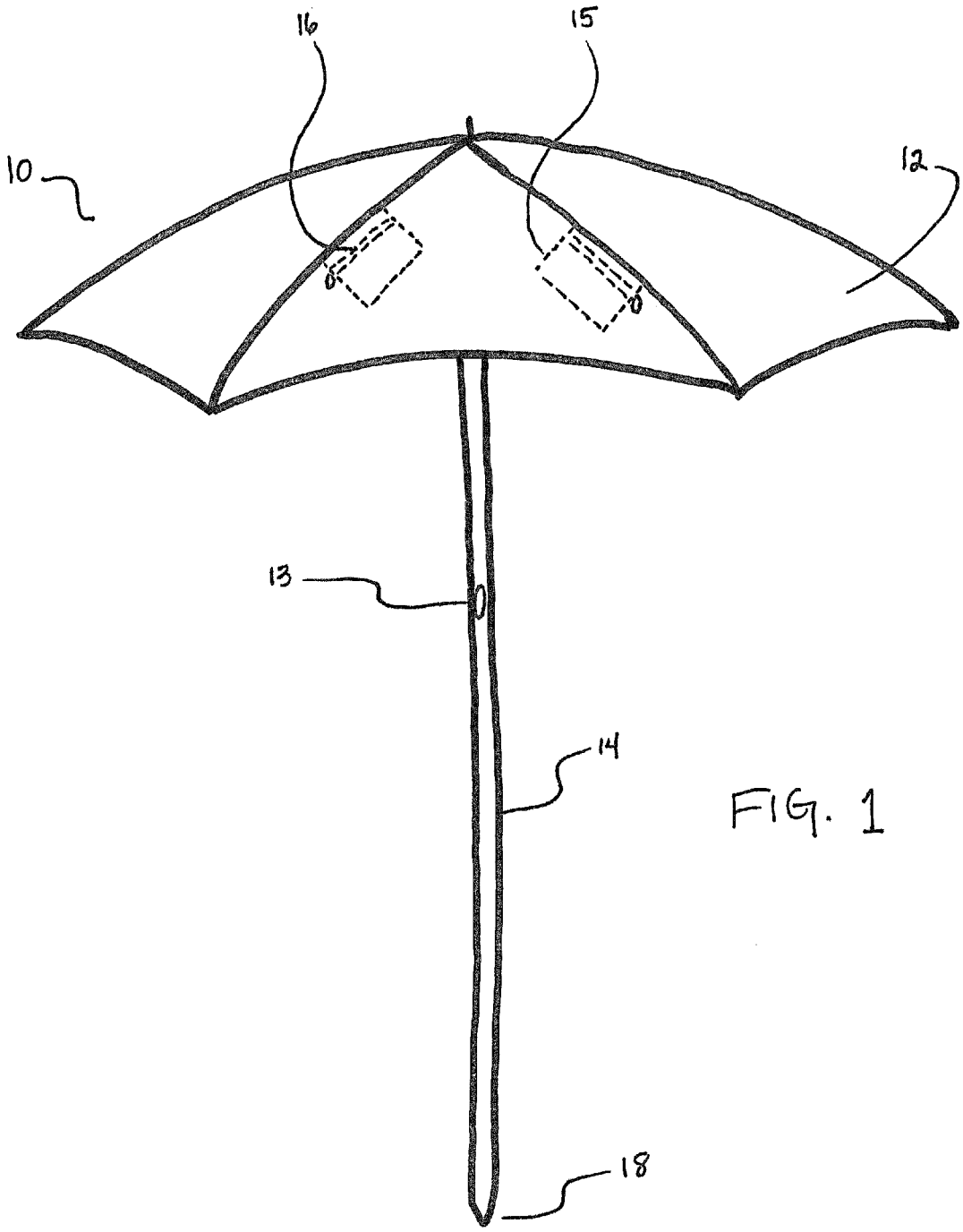
FIG. 1 is a front perspective view of a beach umbrella according to the present invention.

Central support shaft 14 should be made of a lightweight, yet sturdy material such as aluminum, PVC or other suitable plastic. The shaft 14 has an upper end at which the umbrella or shade member 12 is mounted and a base end 11 of a suitable shape to pierce soft ground or sand. The shaft 14 is substantially uniform in cross section and preferably has a sharply tapered end 18 so as to allow easy penetration of the sand and or ground so that the support shaft 14 may be inserted into the ground or sand. In the case where the beach bag or container (anchor member) is provided, the shaft 14 can be inserted into an opening provided at the top of the container, pass through the sand, earth or other ballast provided therein, and penetrate into the underlying sand or ground. At least one pocket 15 made of a suitable, lightweight material, preferably plastic which is durable any may contain openings to provide a mesh-like appearance, is attached to at least one interior seam of the umbrella.

Figure 2:
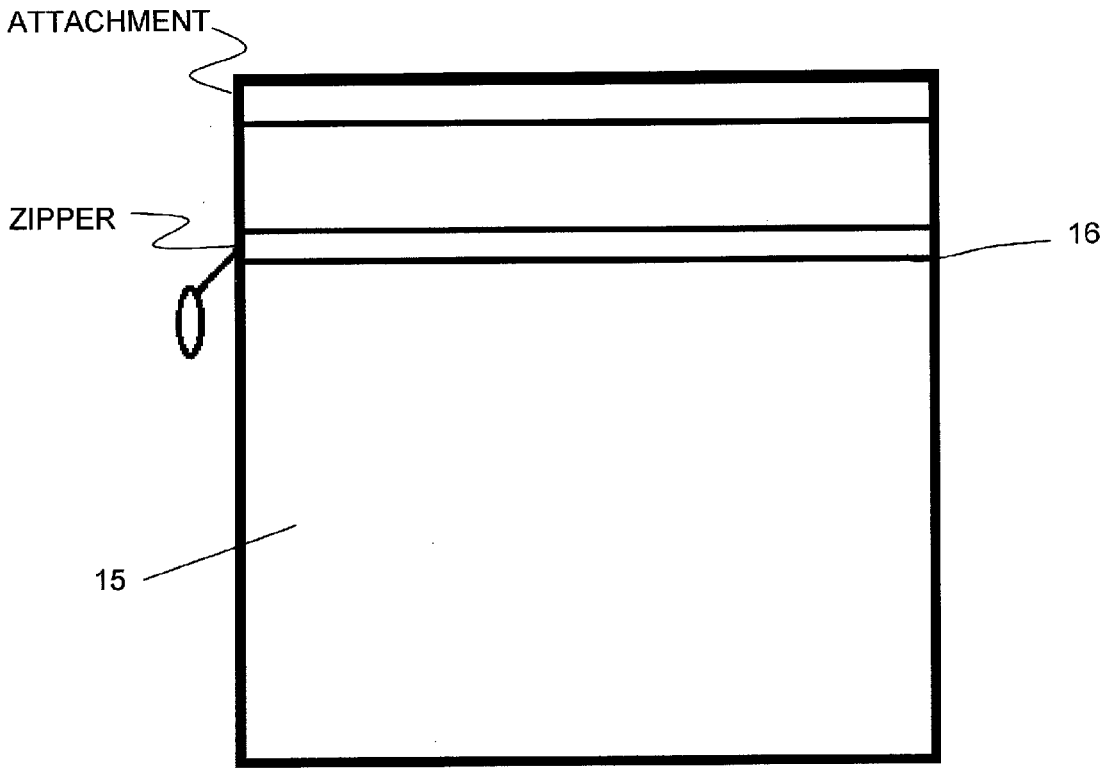
FIG. 2 is a front perspective view of a storage pocket shown in FIG. 1.
Figure 3:
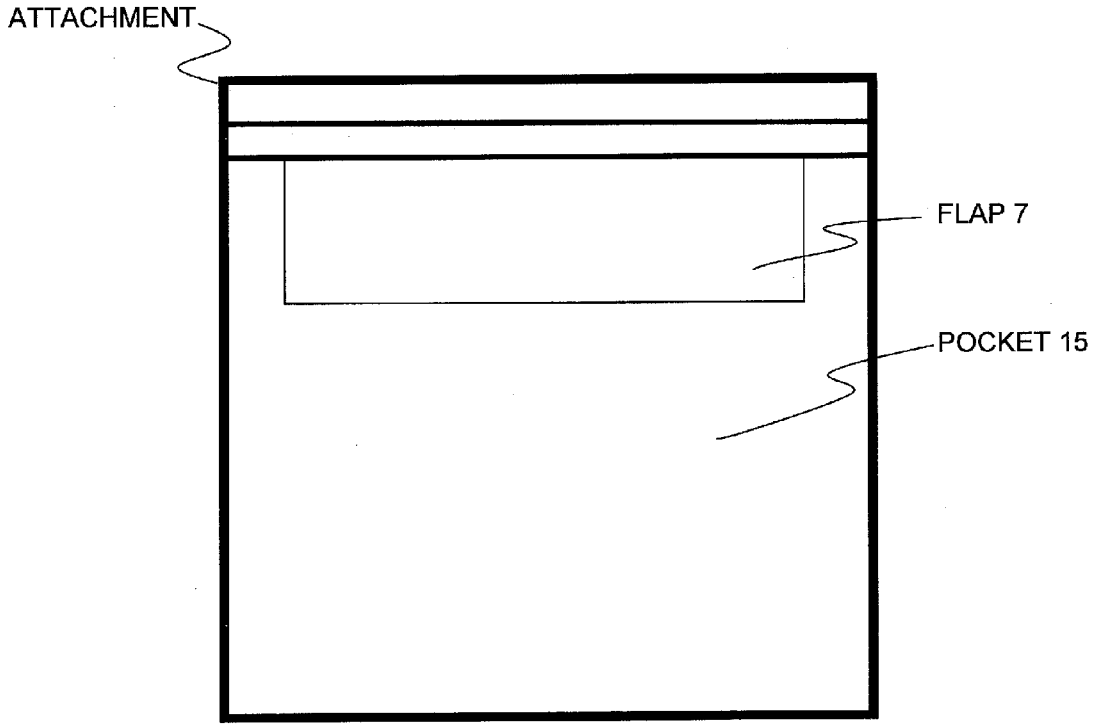
FIG. 3 is a front perspective view according to a second preferred embodiment of the storage pocket of the invention.

As seen in FIGS. 2 and 3, the pocket(s) 15 are provided with an opening closable by a zipper 16 or flap 17 for gaining access to the interior of the pocket 15. Any conceivable use may be made of this pocket, including storage of keys, money, cassettes, suntan lotion, reading materials, glasses or the like.

In order to provide stability and prevent unexpected gusts of wind or gusts of wind of greater force than expected from causing the umbrella 10 to topple, or even more dangerously, allow the umbrella to topple with the tapered end of the support shaft 14 flailing about, the umbrella 10 as shown in FIG. 1 is fitted with an anchoring member (beach bag or container).

Figure 4A:
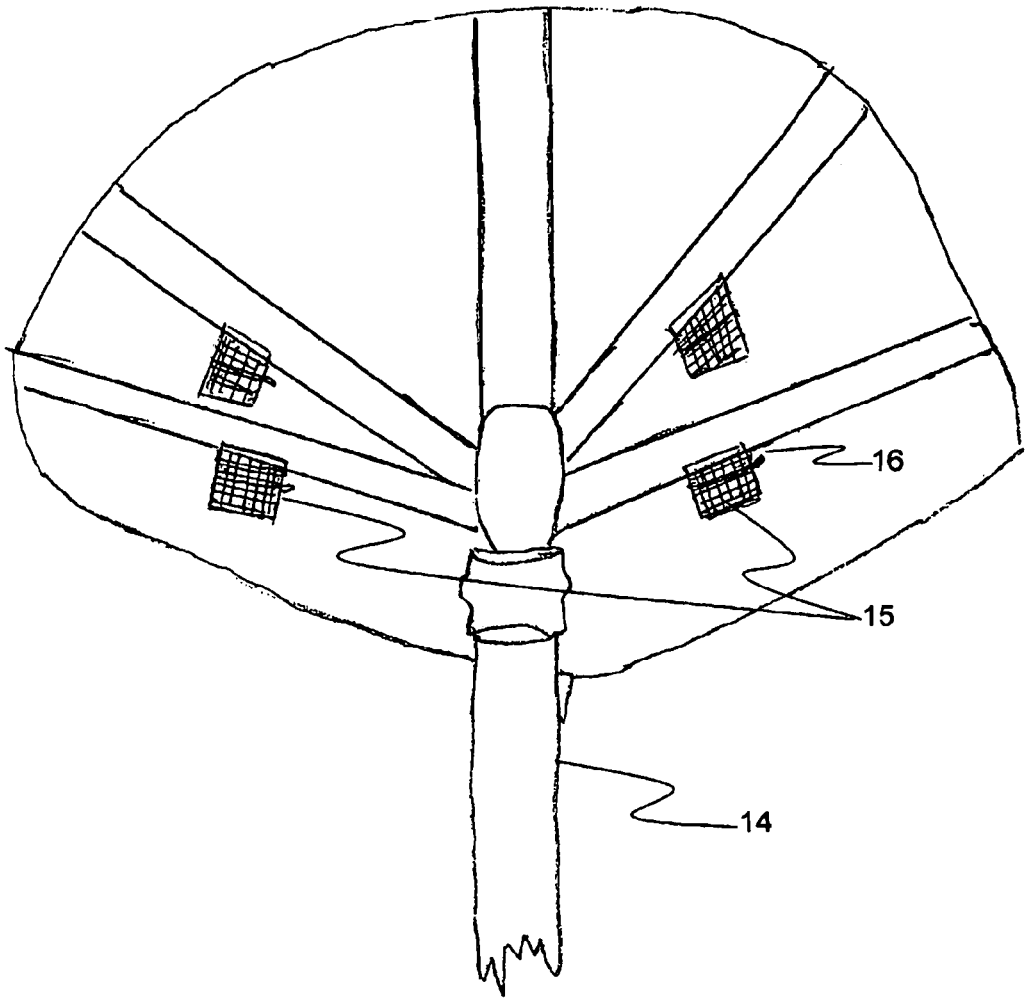
FIG. 4A shows the interior of the portable umbrella with the pockets attached.
Figure 4B:
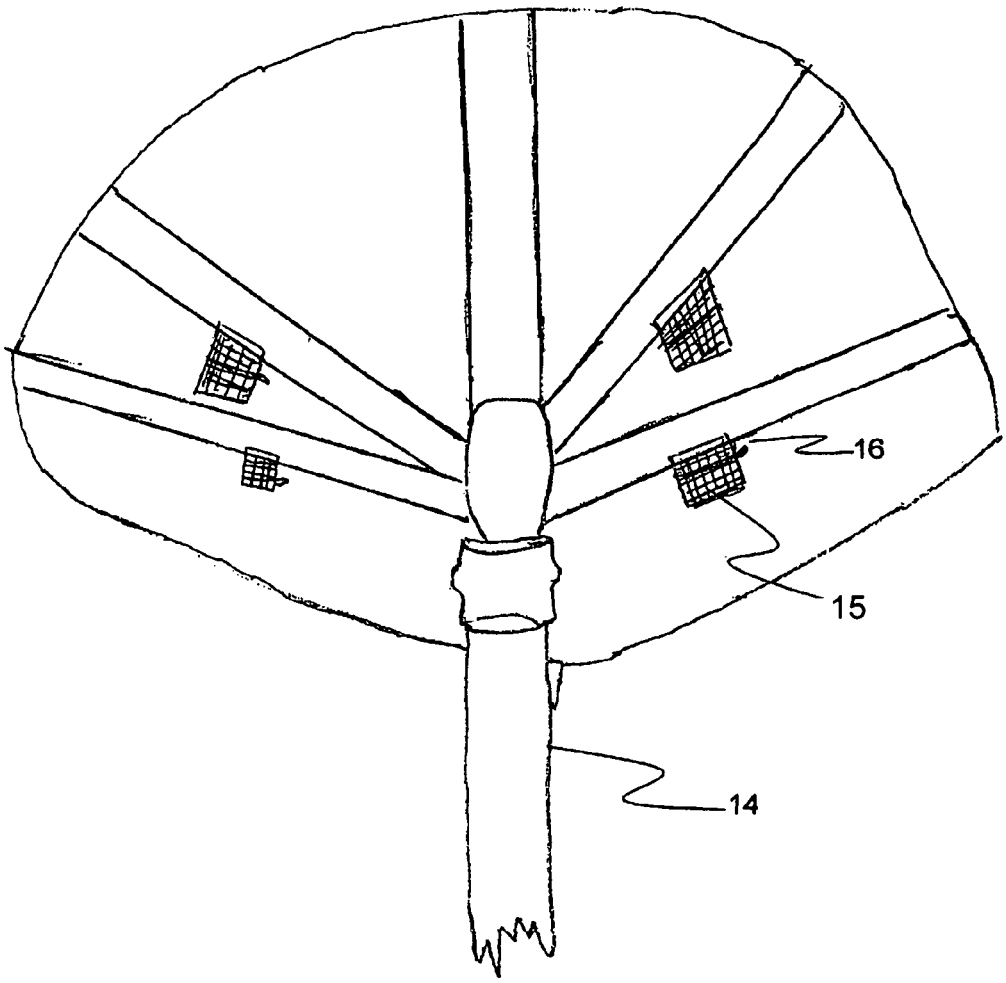
FIG. 4B shows the interior of an alternate embodiment of the portable umbrella with the pockets attached.
Figure 5A:
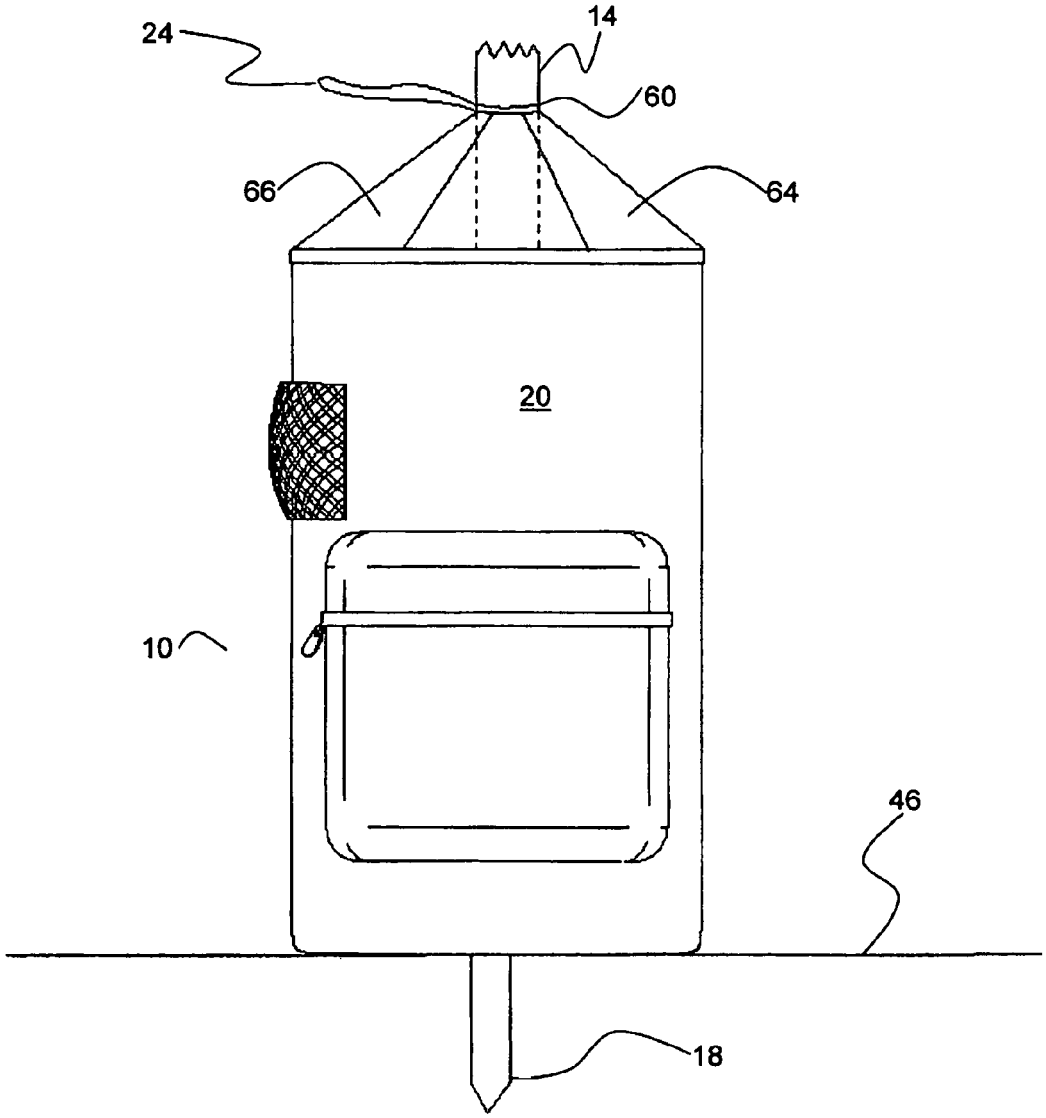
FIG. 5A is a front perspective view of the anchoring system of the present invention attached to a beach umbrella.

FIGS. 4A and 5A illustrate the portable umbrella and an anchor member respectively for utilization in the present anchoring system, which comprises a container or bag for receiving a weighting medium. The anchor member is preferably provided in the form of a conventional beach bag except that is closed at the top other than for an opening to allow introduction of the tapered end of the shaft, its passage therethrough and out through an opening in the bottom of the container.

In FIG. 4A, an embodiment of the interior portable umbrella showing a plurality of pockets 15 as attached at the interior seams of the umbrella. The umbrella is in its open position.

Figure 5B:
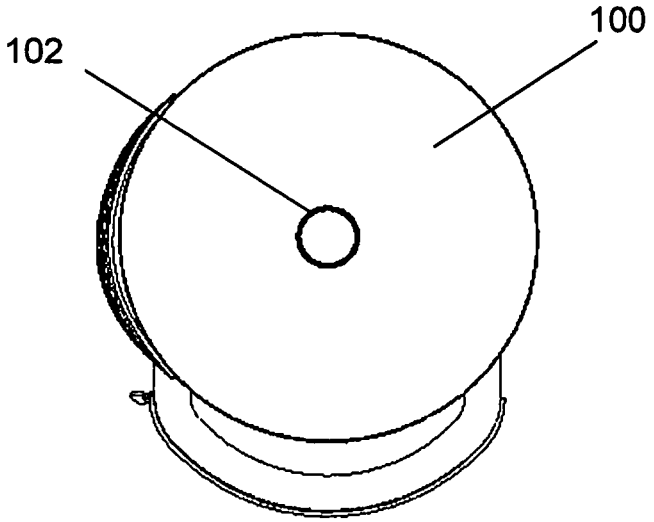
FIG. 5B is a bottom view of the anchoring system of FIG. 5A.

FIG. 5A shows the anchoring apparatus 20 in accordance with the invention. Here, the drawstring 24 has been pulled tight thereby cinching the top opening 60 of the anchoring apparatus. When the top 60 is cinched around the umbrella pole or shaft 14, pleats or gussets 66 and 64 are formed, folding in toward the pole. Not shown in this figure is optional cinching barrel clasp 26 which may be used to keep the drawstring 24 cinched closed around the umbrella pole 14. FIG. 5B is a bottom view of the anchoring apparatus 20 showing the concentric opening 102 in the bottom 100 of the anchoring apparatus.

Figure 6:
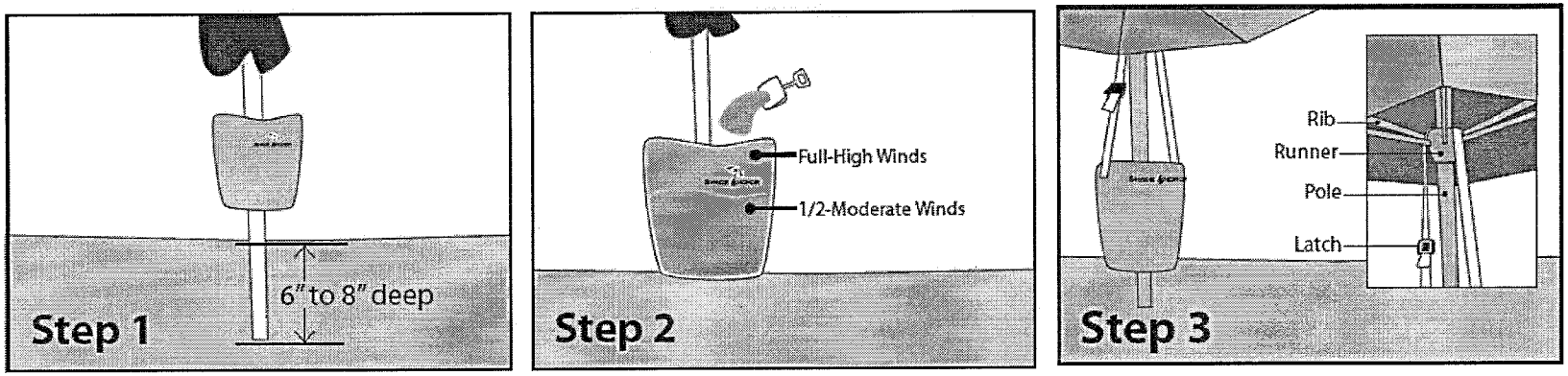
FIG. 6 illustrates the method of using the beach umbrella anchoring system of the invention.

In FIG. 6, a series of steps are shown illustrating how to use the anchoring apparatus. In Step 1, as shown in FIG. 6, the umbrella pole is passed through the anchoring apparatus, and embedded about 6 to 8 inches into the sand below. In step 2, the anchoring apparatus is filled with sand to support the umbrella pole and act as ballast for the umbrella. Any suitable amount of sand may be used, relative to the environmental conditions. A day with high winds will require more sand to anchor the umbrella than a calm day with no wind. In step 3, the umbrella is secured with a latch to the pole, thereby anchoring the umbrella to the weight of the sand in the anchoring apparatus.

The beach bag as illustrated, when filled with sand, will provide a suitable anchor for the anchoring system of the present invention. In this regard, it would be noted that one cubic foot of sand weighs between about 90 and 110 pounds. Thus, a beach bag of one or two cubic foot capacity should be adequate to provide anchoring for even the largest umbrellas.

The invention claimed is:

1. A beach umbrella anchoring system comprising (1) an anchor member comprising a beach bag for containing a weighting medium and (2) a beach umbrella comprising:

(a) a vertical central support shaft;

(b) a closeable umbrella member mounted adjacent an upper end of said support shaft, said umbrella member having an open position and a closed position;

(c) a lower end of said shaft having a suitable shape to pierce soft earth or sand;

(d) said beach bag containing a weighting medium, the lower end of said shaft being insertable into said weighting medium, said beach bag further comprising (i) a rigid central ballast container structure having a bottom panel having a generally concentric opening to an interior of the central ballast container structure, wherein said generally concentric opening is adapted to permit the lower end of said support shaft to protrude therefrom for placement upon and for penetrating into a sand or earth base; (ii) an upper opening panel securely attached or integral to the central ballast container structure, the upper opening panel is configured to receive the support shaft and having a closure configured to enclose the support shaft deployed through the upper opening panel and, (iii) a drawstring at a top of said beach bag which can be pulled tight cinching the upper opening panel of said ballast container structure around the support shaft; and (e) a first interiorly accessible pocket member made of a mesh-like material for holding small personal items, wherein the first pocket member is affixed to a first interior seam of said closeable umbrella member so that the first pocket member hangs downwards from said first interior seam when the umbrella member is in the open position, thereby allowing air to flow freely through the mesh-like material.

2. A beach umbrella anchoring system according to claim 1 wherein said lower end of said shaft is insertable into the sand or soft ground subsequent to insertion and passage of said shaft through said beach bag.

3. A beach umbrella anchoring system according to claim 1 wherein said at least one pocket member serves as a drying area.

4. A beach umbrella anchoring system according to claim 1 wherein said first interiorly accessible pocket member is affixed to said first interior seam of said closeable umbrella member by sewing, gluing or Velcro®.

5. A beach umbrella anchoring system according to claim 1 wherein the lower end of said beach bag has a generally concentric smaller opening to an exterior adapted to permit the lower end of said shaft to protrude through said opening for placement upon and for penetrating a sand or earth base.

6. The beach umbrella anchoring system of claim 1, further comprising a second interiorly accessible pocket member made of a mesh-like material for holding small personal items, wherein the second pocket member is affixed to a second interior seam of the closeable umbrella member so that the second pocket member hangs downwards from said second interior seam when the umbrella member is in the open position, thereby allowing air to flow freely through the mesh-like material.

7. The beach umbrella anchoring system of claim 6, further comprising:

a third interiorly accessible pocket member made of a mesh-like material for holding small personal items, wherein the third pocket member is affixed to a third interior seam of the closeable umbrella member so that the third pocket member hangs downwards from said third interior seam when the umbrella member is in the open position, thereby allowing air to flow freely through the mesh-like material; and a fourth interiorly accessible pocket member made of a mesh-like material for holding small personal items, wherein the fourth pocket member is affixed to a fourth interior seam of the closeable umbrella member so that the fourth pocket member hangs downwards from said fourth interior seam when the umbrella member is in the open position, thereby allowing air to flow freely through the mesh-like material.

8. A beach umbrella for upright positioning in soft earth or sand and for storing personal articles such as wallets, car keys, money, jewelry, glasses, sun screen, and clothing, and for drying wet articles of clothing, the beach umbrella comprising:

(a) a vertical central support shaft, wherein a lower end of said support shaft has a suitable shape to pierce the soft earth or sand;

(b) a closeable umbrella member mounted adjacent an upper end of said support shaft, said umbrella member having a first interior seam, an open position and a closed position; and (c) a first pocket member made of a flexible, lightweight, mesh-like material having a pocket edge which is affixed to said first interior seam, so that when the umbrella member is in said open position said first pocket member hangs downward and away from said first interior seam to allow air to flow freely through said mesh-like material, (d) whereby said first pocket member is suitable for housing the personal articles, and for drying the articles of clothing through the passage of air through said mesh-like material.

9. A breach umbrella according to claim 8, further comprising second and third pocket members made of said flexible, lightweight, mesh-like material, respectively affixed to a second and third interior seam in said umbrella member.

* * * * *